US009997280B2

(12) United States Patent
Nakamura et al.

(10) Patent No.: US 9,997,280 B2
(45) Date of Patent: Jun. 12, 2018

(54) HEAT-RESISTANT WIRE AND HEAT-RESISTANT CABLE

(71) Applicant: Hitachi Metals, Ltd., Tokyo (JP)

(72) Inventors: Yoshiaki Nakamura, Hitachi (JP); Shuichi Tadokoro, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days. days.

(21) Appl. No.: 15/203,280

(22) Filed: Jul. 6, 2016

(65) Prior Publication Data

US 2017/0011822 A1 Jan. 12, 2017

(30) Foreign Application Priority Data

Jul. 6, 2015 (JP) ..... 2015-135218

(51) Int. Cl.
*H01B 7/295* (2006.01)

(52) U.S. Cl.
CPC ..... *H01B 7/295* (2013.01)

(58) Field of Classification Search
CPC combination set(s) only.
See application file for complete search history.

(56) References Cited

U.S. PATENT DOCUMENTS 3,838,108 A * 9/1974 Hergenrother et al. ..... C08G 18/10 528/73
7,453,043 B2 * 11/2008 Park ..... H02G 3/123 174/110 R
7,897,673 B2 * 3/2011 Flat ..... C08G 81/028 524/126
2002/0096356 A1 * 7/2002 Kim ..... H01B 1/12 174/137 A
2006/0074158 A1 * 4/2006 Blondel ..... C08K 5/435 524/169
2013/0228358 A1 * 9/2013 Fujimoto ..... H01B 7/292 174/110 SR
2015/0105510 A1 * 4/2015 Sabard ..... B32B 27/08 524/450

FOREIGN PATENT DOCUMENTS

JP 2013214487 A 10/2013

* cited by examiner

*Primary Examiner* — Timothy Thompson
*Assistant Examiner* — Krystal Robinson
(74) *Attorney, Agent, or Firm* — Roberts Mlotkowski Safran Cole & Calderon, P.C.

(57) ABSTRACT

A heat-resistant wire includes a conductor, and an insulation including not less than two layers and covering the conductor. An outermost layer of the insulation includes a flame-retardant resin composition having a melting point of not less than 200° C. and is cross-linked by exposure to ionizing radiation, the flame-retardant resin composition including a polyolefin grafted with polyamide as a base polymer.

17 Claims, 2 Drawing Sheets

HEAT-RESISTANT WIRE AND HEAT-RESISTANT CABLE

The present application is based on Japanese patent application No.2015-135218 filed on Jul. 6, 2015, the entire contents of which are incorporated herein by reference.

BACKGROUND OF THE INVENTION

1. Field of the Invention

The invention relates to a heat-resistant wire and a heat-resistant cable and, in particular, to a heat-resistant wire and a heat-resistant wire cable used for railroad vehicles.

2. Description of the Related Art

Electric wires and cables used in an application requiring high reliability (electric wires and cables for, e.g., nuclear power plants or railroad vehicles) are required to have not just only insulating properties but also to have mechanical characteristics and long service life and to be safe against fire accidents.

For electric wires and cables for, e.g., nuclear power plants, the environmental test method and the flame-retardant test method are defined in The Institute of Electrical and Electronics Engineers (IEEE) Standard 383 and Technical Report of IEE Japan (II), No.139 of Institute of Electrical Engineers of Japan (Japan Domestic Version). Materials to be used and test methods, etc., for railroad vehicle wires and cables are also defined even though the specification is slightly different in each country or region in the world.

Comparing to electric wires and cables used for general purposes, railroad vehicle wires and cables especially need to have not only just high flame retardancy but also mechanical characteristics in a high temperature condition with an electric current flowing, water resistance in a long-term water-immersion environment and resistance to oil such as lubricant oil due to the use environment.

On the other hand, weight reduction and downsizing are important issues for railroad vehicles. Electric wires and cables used therein are no exception and are required to be lighter in weight and to have a smaller diameter so as to fit in a reduced wiring space along with downsizing of vehicles.

Methods of reducing diameter of electric wire are, e.g., a method in which heat resistance of covering material is improved by increasing the allowable current for electric wire to allow a conductor cross sectional area to be reduced, and a method in which thickness of covering material is reduced by improving mechanical characteristics and insulation resistance of the covering material.

Although reduction in the diameter of conductor and the thickness of covering material can be achieved by using a fluorine resin or an engineering plastic having excellent heat resistance and mechanical characteristics as a covering material, such covering materials are expensive and cause over-engineering in case of electric wires used in an application in which the current flowing therethrough is little. In addition, such materials are often highly crystalline and rigid resins, and cause fitting properties to be poor.

JP-A-2013-214487 has proposed a multilayer insulated wire provided with a conductor, an inner layer covering the conductor and an outer layer further covering the inner layer. The inner layer is formed of a resin material containing at least calcined clay added in an amount of 10 to 100 parts by weight per 100 parts by weight of base polymer consisting mainly of modified poly(2,6-dimethyl phenylene ether), and the outer layer is formed of a polyester resin composition containing 50 to 150 parts by weight of polyester block copolymer, 0.5 to 3 parts by weight of hydrolysis inhibitor and 10 to 30 parts by weight of magnesium hydroxide per 100 parts by weight of base polymer consisting mainly of a polyester resin.

SUMMARY OF THE INVENTION

JP-A-2013-214487 states that the obtained halogen-free multilayer insulated wire is excellent in heat resistance, flame retardancy, abrasion resistance and hydrolysis resistance, has low smoking property and low toxicity and notably complies with the EN standard, but it does not refer to the long-term water-immersion properties. Although hydrolysis resistance is taken into consideration because the polyester resin composition is used to form the outer layer, it is hard to deny the possibility that hydrolysis occurs when used in a harsh place under long-term water immersion.

It is an object of the invention to provide a heat-resistant wire and a heat-resistant cable, particularly a railroad vehicle heat-resistant wire and cable with a small diameter, which are excellent in mechanical characteristics and long-term water-immersion properties.

(1) According to an embodiment of the invention, a heat-resistant wire comprises:

a conductor; and an insulation comprising not less than two layers and covering the conductor, wherein an outermost layer of the insulation comprises a flame-retardant resin composition having a melting point of not less than 200° C. and is cross-linked by exposure to ionizing radiation, the flame-retardant resin composition comprising a polyolefin grafted with polyamide as a base polymer.

In the above embodiment (1) of the invention, the following modifications and changes can be made.

(i) A layer of the insulation other than the outermost layer comprises a resin composition, and a base polymer of the resin composition comprises one or two or more selected from high-density polyethylene, linear low-density polyethylene, low-density polyethylene, ethylene-α-olefin copolymer, ethylene-vinyl acetate copolymer, ethylene-acrylic ester copolymer and ethylene-propylene-diene copolymer.

(ii) The polyamide has a melting point of not less than 200° C.

(iii) A total thickness of the insulation is not more than 0.5 mm and the outer diameter of the wire is not more than 2.5 mm.

(2) According to another embodiment of the invention, a heat-resistant cable comprises:

a twisted wire formed by twisting a plurality of the heat-resistant wires according to embodiment (1); and a sheath formed by extruding a flame-retardant resin composition to cover the twisted wire, wherein the sheath is cross-linked by exposure to ionizing radiation.

EFFECTS OF THE INVENTION

According to an embodiment of the invention, a heat-resistant wire and a heat-resistant cable, particularly a railroad vehicle heat-resistant wire and cable with a small diameter can be provided which are excellent in mechanical characteristics and long-term water-immersion properties.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Heat-Resistant Wire

Figure 1:
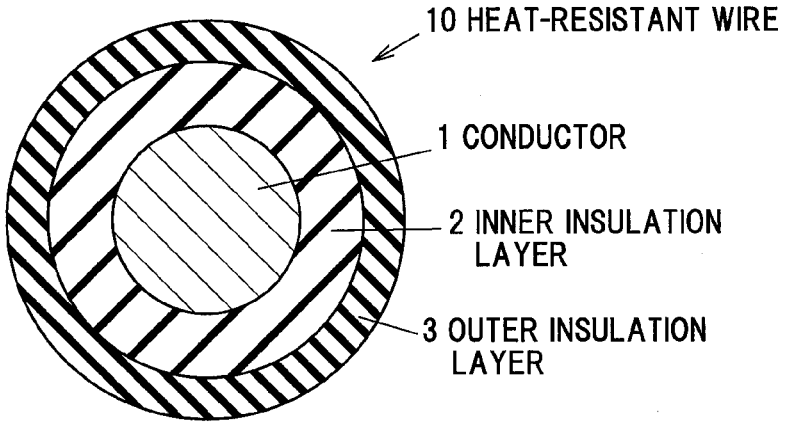
FIG. 1 is a cross sectional view showing an example of a heat-resistant wire in an embodiment of the present invention.

FIG. 1 is a cross sectional view showing an example of a heat-resistant wire in an embodiment of the invention.

A heat-resistant wire 10 in the embodiment of the invention is provided with a conductor 1 and an insulation which is composed of not less than two layers (an inner insulation layer 2 and an outer insulation layer 3) and covers the conductor 1. The outer insulation layer 3 as the outermost layer of the insulation is formed of a flame-retardant resin composition having a melting point of not less than 200° C. and containing a polyolefin grafted with polyamide as a base polymer, and is cross-linked by exposure to ionizing radiation.

Conductor

A conductor commonly used for insulated wire can be used as the conductor 1. It is possible to used, e.g., a copper wire or a silver-plated wire. The conductor 1 may be either a solid wire or a twisted wire.

Outer insulation layer

The outer insulation layer 3, which is the outermost layer of the insulation composed of not less than two layers, is formed of a flame-retardant resin composition having a melting point of not less than 200° C. and using a polyamide-grafted polyolefin as a base polymer. The melting point of the flame-retardant resin composition is exemplarily not less than 205° C., more exemplarily, not less than 210° C. The melting point of the polyamide-grafted polyolefin as the base polymer is also not less than 200° C., exemplarily not less than 205° C., and more exemplarily not less than 210° C.

The polyolefin to be a main chain of the base polymer is not specifically limited but is desirably an ethylene-based polymer or copolymer in view of flexibility. It is exemplar to use high-density polyethylene, linear low-density polyethylene, low-density polyethylene, ethylene-α-olefin copolymer, ethylene-vinyl acetate copolymer, ethylene-acrylic ester copolymer and ethylene-propylene-diene copolymer, etc. Low-density polyethylene, ethylene-α-olefin copolymer, ethylene-vinyl acetate copolymer and ethylene-acrylic ester copolymer are particularly exemplar. These materials may be used alone or in combination of two or more.

Polyamides when containing aliphatic backbones are generally collectively called nylon and several types of polyamides having different chemical structures have been placed on the market. Properties such as melting point are also different depending on the structural difference. In railroad vehicles, it is expected that electric wires are also used in a high-temperature environment. Therefore, a high-melting-point (highly heat-resistant) polyamide is exemplar, and a polyamide having a melting point of not less than 200° C., e.g., polyamide 6, is suitable. A polyamide having a melting point of not less than 210° C. is more exemplar. Polyamide 11 and polyamide 12, which have a melting point of less than 200° C., are not really suitable. A condensation copolymer formed by the reaction of a diamine and a dicarboxylic acid can be also used.

Polyamide is relatively cheap as an engineering plastic but is hydrolyzable. However, in the invention, the polyamide is solely a polymer to be grafted and the main chain is polyolefin. Therefore, the polyamide-grafted polyolefin has better hydrolysis resistance than commonly used polyamide, urethane-based resins or elastomers, or polyester-based resins or elastomers. It was also found that the polyamide-grafted polyolefin is excellent in long-term water-immersion properties.

Although the polyamide-grafted polyolefin is flame resistant due to polyamide having flame retardancy, a flame retardant can be appropriately added to increase flame retardancy of the electric wire.

Examples of flame retardant which can be used include bromine-based flame retardants typified by decabromodiphenyl-ethane, chlorine-based flame retardants, antimony trioxide, nitrogen-based flame retardants such as melamine cyanurate compound, phosphorus-based flame retardants such as red phosphorus and intumescent flame retardant, metal hydroxides, boric-acid compounds, stannate compounds and silicone-based flame retardants, etc. Bromine-based flame retardants, antimony trioxide and nitrogen-based flame retardants are particularly exemplar.

To the base polymer, it is possible, if necessary, to add additives such as antioxidant, lubricant, surface active agent, plasticizer, inorganic filler, compatibilizing agent, stabilizer, metal chelator (copper inhibitor), ultraviolet absorber, light stabilizer and colorant.

The amount of the polyamide-grafted polyolefin as the base polymer contained in the flame-retardant resin composition used to form the outer insulation layer 3 is exemplarily not less than 80 mass %, more exemplarily not less than 90 mass %, further exemplarily not less than 95 mass %.

The flame-retardant resin composition used to form the outer insulation layer 3 as the outermost layer is cross-linked by exposure to ionizing radiation. The heat-resistant wire, when used in a railroad vehicle, may locally become high temperature or may be exposed to a deformation force or a machine lubricant oil in a high-temperature atmosphere. Therefore, the covering material formed of a resin composition and used for the heat-resistant wire needs to be cross-linked.

General methods for cross-linking resin composition include vulcanization using sulfur or sulfur compound, peroxide cross-linking using organic peroxide, silane cross-linking performed by grafting a silane compound onto a base polymer, and cross-linking using exposure to ionizing radiation such as electron beam. In the embodiment of the invention, vulcanization using sulfur or sulfur compound is unsuitable since the main chain of the base polymer constituting the resin composition needs to have double bonds. Meanwhile, when using an organic peroxide, the main chain of the base polymer does not need to have double bonds but heat and time are required to cross-link and it is thus not possible to provide high-speed extrudability. In addition, the polyamide-grafted polyolefin needs to be extruded at not less than 200° C. based on the melting point thereof and may be progressively cross-linked inside an extruder due to high temperature and thus could not be extruded, hence, not exemplar. In silane cross-linking, a step of grafting a silane compound onto an organic peroxide is generally performed. However, the polyamide-grafted polyolefin is less likely to be grafted and also may be progressively cross-linked inside an extruder and could not be extruded in the same manner as the cross-linking using organic peroxide, hence, not exemplar. On the other hand, with the cross-linking using exposure to ionizing radiation, polymers containing tertiary carbons and undergoing radioactive decay cannot be used as a base polymer but other polymers can be cross-linked regardless of the structure thereof. In addition, since this cross-linking is performed after extrusion molding, the resin composition used as a covering material of the heat-resistant wire can be cross-linked without progress of cross-linking inside the extruder. The polyamide-grafted polyolefin is not a polymer containing tertiary carbons and undergoing radioactive decay, and use of cross-linking by exposure to ionizing radiation is the most suitable.

Cross-linking is performed by, e.g., exposure to exemplarily 10 kGy to 500 kGy, more exemplarily 100 kGy to 300 kGy, of ionizing radiation such as electron beam, gamma ray, X-ray or alpha ray at a dose rate of 1 to 10 kGy/h, but it is not limited thereto.

Inner Insulation Layer

The polyamide-grafted polyolefin used to form the outermost layer is likely to absorb water and is poor in water-resistant and electrically-insulating properties even though high polarity of polyamide makes the polymer main chain highly resistant to hydrolysis under water immersion. However, it was found that such a problem can be solved by providing an insulation having a multilayer structure.

Considering that the heat-resistant wire is used in railroad vehicle, the inner insulation layer 2, which is one of two or more layers of the insulation and is not the outermost layer, is exemplarily formed of a flame-retardant resin composition, more exemplarily, a flame-retardant resin composition having high water-resistant and electrically-insulating properties.

The base polymer of the resin composition used to form the inner insulation layer 2 is exemplarily a polymer having low polarity and low absorption. It is particularly exemplar that a polymer(s) selected from high-density polyethylene, linear low-density polyethylene, low-density polyethylene, ethylene-α-olefin copolymer, ethylene-vinyl acetate copolymer, ethylene-acrylic ester copolymer and ethylene-propylene-diene copolymer be used alone or in combination of several types. A heat-resistant wire not only excellent in mechanical characteristics and long-term water-immersion properties but also excellent in water-resistant and electrically-insulating properties can be thereby obtained at relatively low cost.

When the outermost layer of insulation is formed using a high-melting-point fluorine resin such as ethylene-tetrafluoroethylene copolymer, tetrafluoroethylene fluoroalkoxy vinyl ether copolymer and tetrafluoroethylene hexafluoride propylene copolymer, or a high-melting-point engineering plastic such as polyether ether ketone, the extrusion temperature is sometimes more than 300° C. and this limits the choice of resin composition which can be used to form the layer(s) other than the outermost layer. On the other hand, when the polyamide-grafted polyolefin is used to form the outermost layer of insulation as is in the invention, it is possible to reduce the extrusion temperature to not more than 250° C., and a based polymer of the resin composition used to form the layer(s) other than the outermost layer can be selected from a wider range of materials.

To the resin composition used to form the inner insulation layer 2, it is possible, if necessary, to add additives such as flame retardant, antioxidant, lubricant, surface active agent, softener, plasticizer, inorganic filler, compatibilizing agent, stabilizer, metal chelator (copper inhibitor), ultraviolet absorber, light stabilizer and colorant.

Of the previously-listed flame retardants which can be used here, bromine-based flame retardants and antimony trioxide are exemplar in view of water-resistant and electrically-insulating properties.

The amount of the base polymer contained in the flame-retardant resin composition used to form the inner insulation layer 2 is exemplarily not less than 50 mass %.

The flame-retardant resin composition constituting the inner insulation layer 2 is desirably cross-linked by exposure to ionizing radiation in the same manner as the flame-retardant resin composition constituting the outer insulation layer 3.

Although one inner insulation layer 2 is provided in the present embodiment, two or more inner insulation layers 2 may be provided.

In the heat-resistant wire 10 of the present embodiment, the total thickness of the inner insulation layer 2 and the outer insulation layer 3 is exemplarily not more than 0.5 mm, more exemplarily, from 0.25 to 0.45 mm. The thickness ratio of the inner insulation layer 2 to the outer insulation layer 3 is exemplarily the inner insulation layer 2/the outer insulation layer 3=2/1 to 4/1.

Heat-Resistant Cable

Figure 2:
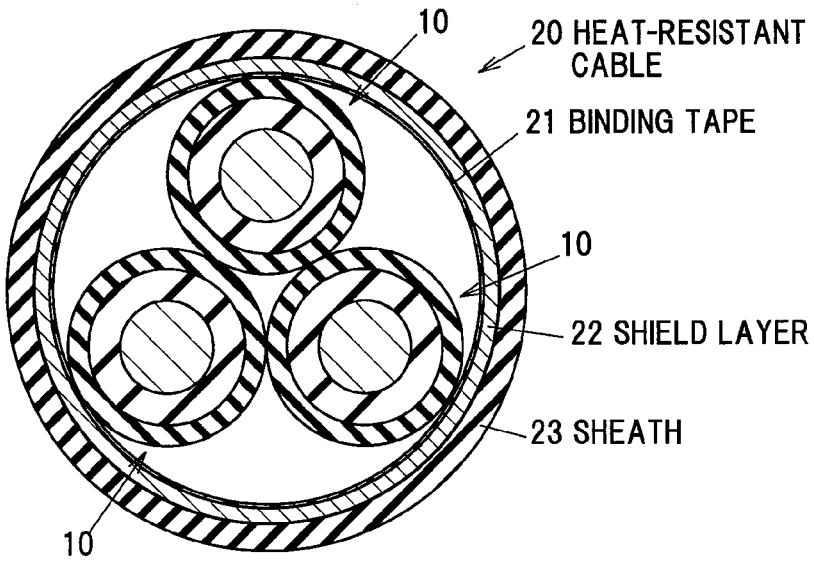
FIG. 2 is a cross sectional view showing an example of a heat-resistant cable in the embodiment of the invention.

FIG. 2 is a cross sectional view showing an example of a heat-resistant cable in the embodiment of the invention.

A heat-resistant cable 20 in the embodiment of the invention is provided with a twisted wire formed by twisting plural heat-resistant wires 10 in the embodiment of the invention and a sheath 23 formed by extruding a flame-retardant resin composition to cover the twisted wire. The sheath 23 is cross-linked by exposure to ionizing radiation.

Although the embodiment shown in FIG. 2 is configured such that a binding tape 21 such as PET tape is wound around the twisted wire, a shield layer 22 formed of a metal braid is provided around the binding tape 21 and the sheath 23 is provided around the shield layer 22, the configuration is not limited thereto.

The resin composition as a material of the sheath 23 is not specifically limited but needs to be a flame-retardant resin composition since heat-resistant railroad vehicle cables are also required to have high flame retardancy.

The previously-mentioned resin compositions for the inner insulation layer 2 or the outer insulation layer 3 can be used to form the sheath 23. However, the resin composition constituting the outer insulation layer 3 as the outermost layer of the heat-resistant wire 10 is a relatively hard material. Therefore, when cables are required to have flexibility, it is exemplar to use a resin composition using polyolefin as a base resin in the same manner as the resin composition used to form the inner insulation layer 2.

In the heat-resistant wire 10, a low-polarity polymer is exemplar as a base polymer of the resin composition used to form the layer(s) (the inner insulation layer 2) other than the outermost layer to provide water-resistant and electrically-insulating properties. On the other hand, the sheath material does not need to have water-resistant and electrically-insulating properties and can be a resin composition using a halogenated polyolefin so as to allow a heat-resistant cable excellent in flame retardancy to be obtained at low cost.

Also to the flame-retardant resin composition used as a sheath material, it is possible, if necessary, to add additives such as flame retardant, antioxidant, lubricant, surface active agent, softener, plasticizer, inorganic filler, compatibilizing agent, stabilizer, metal chelator (copper inhibitor), ultraviolet absorber, light stabilizer and colorant.

Also for the heat-resistant cable 20, cross-linking is required since it is expected to be used in a high-temperature environment. For the same reason as for the heat-resistant wire 10, cross-linking by exposure to ionizing radiation is used to obtain a heat-resistant cable excellent in mechanical characteristics.

The thickness of the sheath 23 of the heat-resistant cable 20 in the present embodiment is exemplarily not more than 1.0 mm, more exemplarily, from 0.3 to 0.7 mm.

Effects of the Embodiment of the Invention

In the embodiment of the invention, it is possible to provide a heat-resistant wire and a heat-resistant cable which are excellent in mechanical characteristics and long-term water-immersion properties. In addition, in the embodiment of the invention, a heat-resistant wire and a heat-resistant cable which are excellent in mechanical characteristics and long-term water-immersion properties can be provided using a relatively cheap covering material. Furthermore, such heat-resistant wire and cable can have small diameters while maintaining excellent characteristics thereof. For example, the heat-resistant wire 10 can have an outer diameter of not more than 2.5 mm and the heat-resistant cable 20 can have an outer diameter of not more than 8 mm. Therefore, the heat-resistant wire and the heat-resistant cable in the present embodiment are suitable for use in railroad vehicles.

EXAMPLES

Next, the invention will be described in more detail based on Examples. However, the invention is not limited thereto.

Example 1

Materials mixed according to the proportions shown in Table 1 were kneaded by a 55L wonder kneader. Then, the kneaded mixture was introduced into an extruder, extruded through a strand die and water-cooled after extrusion, thereby obtaining pellets.

The pellets as a material of an inner layer and a polyamide-grafted polyolefin A shown in Table 2 as a material of an outer layer were co-extruded on a 16 AWG copper conductor (conductor cross sectional area of 1.23 $mm^2$ and outer diameter of 1.37 mm) formed by twisting plural tin-plated copper wires together, thereby forming an electric wire having an outer diameter of 2.13 mm (inner layer thickness of 0.28 mm and outer layer thickness of 0.1 mm) shown in the cross sectional view of FIG. 1. The obtained electric wire was exposed to ionizing radiation (electron beam) of 200 kGy, and a thin heat-resistant wire was thereby obtained.

Example 2

A thin heat-resistant wire was obtained in the same manner as Example 1, except that a polyamide-grafted polyolefin B shown in Table 2 was used as the outermost layer material.

Example 3

Three heat-resistant wires obtained in Example 2 were twisted together, a 0.025 mm-thick polyethylene terephthalate tape was wound therearound, and a braid of a tin-plated soft copper wire (conductor cross sectional area of 0.12 $mm^2$) was further provided thereon. Then, a sheath material formed of materials mixed according to the proportions shown in Table 3, kneaded by a 55L wonder kneader and then pelletized was extruded to a thickness of 0.5 mm to cover the braid, thereby obtaining a cable having an outer diameter of 6.25 mm shown in the cross sectional view of FIG. 2. The obtained cable was exposed to ionizing radiation of 200 kGy, and a heat-resistant cable was thereby obtained.

Conventional Example 1

Figure 3:
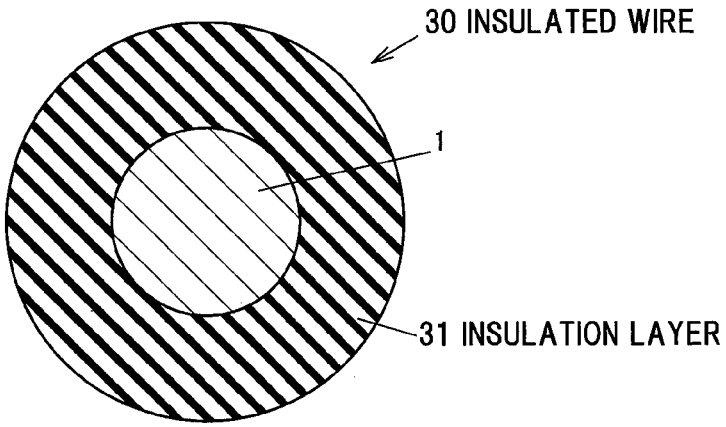
FIG. 3 is a cross sectional view showing an insulated wire in Conventional Examples and Comparative Examples.

The materials shown in Table 1 were kneaded and pelletized in the same manner as Example 1. Then, only the obtained pellets were extruded to form a 0.76 mm-thick single layer on the same copper conductor as that in Example 1, thereby forming an electric wire having an outer diameter of 2.9 mm shown in the cross sectional view of FIG. 3. The obtained electric wire was exposed to ionizing radiation of 200 kGy, and an insulated wire was thereby obtained.

Conventional Example 2

An insulated wire was obtained in the same manner as Conventional Example 1, except that the polyamide-grafted polyolefin A shown in Table 2 was used in place of the pellets.

Comparative Example 1

The materials shown in Table 1 were kneaded and pelletized. Then, only the pellets were extruded to form a 0.38 mm-thick single layer on the same copper conductor as that in Example 1, thereby forming an electric wire having an outer diameter of 2.13 mm shown in the cross sectional view of FIG. 3. The obtained electric wire was exposed to ionizing radiation of 200 kGy, and a thin insulated wire was thereby obtained.

Comparative Example 2

A thin insulated wire was obtained in the same manner as Comparative Example 1, except that the polyamide-grafted polyolefin A shown in Table 2 was used in place of the pellets.

Comparative Example 3

A thin insulated wire was obtained in the same manner as Example 1, except that a polyamide-grafted polyolefin C shown in Table 2 was used as the outermost layer material.

Comparative Example 4

A thin insulated wire was obtained in the same manner as Example 1, except that a thermoplastic urethane elastomer shown in Table 2 was used as the outermost layer material.

Comparative Example 5

A thin insulated wire was obtained in the same manner as Example 1, except that a polybutylene terephthalate (PBT) elastomer shown in Table 2 was used as the outermost layer material.

Comparative Example 6

A thin insulated wire was obtained in the same manner as Example 1, except that a glass fiber-reinforced polyamide 6 shown in Table 2 was used as the outermost layer material.

Comparative Example 7

The electric wire of Example 1 before exposure to ionizing radiation was obtained as a thin insulated wire of Comparative Example 7.

TABLE 1

(parts by mass)

| | | | |
|---|---|---|---|
| Base polymer | Ethylene-vinyl acetate copolymer | Evaflex 460 (Du Pont-Mitsui Polychemical) | 100 |
| Filler | Calcined clay | Santintone SP-33 (BASF) | 40 |
| Flame retardant | Bromine-based flame retardant | SAYTEX 8010 (Albemarle) | 30 |
| Flame retardant | Antimony trioxide | (Twinkling Star) | 10 |
| Antioxidant | Phenol-based antioxidant | Irganox 1010 (BASF) | 1 |
| Antioxidant | Sulfur-based antioxidant | ADK STAB AO-412S (ADEKA) | 1 |
| Colorant | Carbon black | Asahi Thermal Black (Asahi Carbon) | 3 |
| Lubricant | Metallic soap | Zinc stearate (Nittoh Chemical) | 0.5 |
| Crosslinking aid | Multifunctional monomer | TMPT (Shin-Nakamura Chemical) | 5 |

TABLE 2

| | |
|---|---|
| Polyamide-grafted polyolefin A | Apolhya LP81 (ARKEMA), PA6-grafted PO, melting point: 216° C. |
| Polyamide-grafted polyolefin B | Apolhya LP81FRV2 (ARKEMA), flame-retardant PA6-grafted PO, melting point: 216° C. |
| Polyamide-grafted polyolefin C | Apolhya LB1 (ARKEMA), PA11-grafted PO, melting point: 185° C. |
| Thermoplastic urethane elastomer | Elastollan ET890 (BASF) |
| PBT elastomer | PLACCEL BL6707 (Daicel Corporation) |
| Glass fiber-reinforced polyamide 6 | Zytel (DuPont) |

PA6: Polyamide 6,
PA11: Polyamide 11,
PO: Polyolefin

TABLE 3

(parts by mass)

| | | | |
|---|---|---|---|
| Base polymer | Chlorinated polyethylene | ELASLEN 401A (Showa Denko) | 30 |
| Base polymer | Ethylene-vinyl acetate copolymer | Evaflex 260 (Du Pont-Mitsui Polychemical) | 70 |
| Filler | Talc | Mistron Vapor talc | 30 |
| Flame retardant | Bromine-based flame retardant | SAYTEX 8010 (Albemarle) | 10 |
| Flame retardant | Antimony trioxide | (Twinkling Star) | 10 |
| Antioxidant | Phenol-based antioxidant | Irganox 1010 (BASF) | 1 |
| Antioxidant | Sulfur-based antioxidant | ADK STAB AO-412S (ADEKA) | 2 |
| Colorant | Carbon black | Asahi Thermal Black (Asahi Carbon) | 3 |
| Lubricant | Oleic acid bisamide | Slipax O (Nippon Kasei Chemical) | 0.5 |
| Crosslinking aid | Multifunctional monomer | TMPT (Shin-Nakamura Chemical) | 5 |

The obtained electric wires and cables were evaluated and rated by the following methods. The results are shown in Table 4.

(1) Mechanical Characteristics

AAR RP-585, paragraph 5.9.8.1 "Abrasion Resistance test I" and paragraph 5.9.4 "Penetration test" (American standards for railroad vehicle wires) were conducted at an atmosphere temperature of 170° C. The samples which were satisfactory in the both tests were regarded as "Pass". The conditions for 600V rated 16 AWG were used as the test conditions.

(2) Long-Term Water-Immersion Properties

The samples which were satisfactory in AAR RP-585, paragraph 5.6.4

"Long-term insulation resistance test in water" (American standard for railroad vehicle wires) and had good outer appearance without cracks after the test were regarded as "Pass".

(3) Overall Evaluation

The samples which were regarded as "Pass" for both characteristics (1) and (2) were rated as "Pass".

TABLE 4

| | Example 1 | Example 2 | Example 3 | Conv. Ex. 1 | Conv. Ex. 2 | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|---|---|---|---|---|
| Abrasion resistance test I | P | P | P | P | P | F | P | P | P | P | P | P |
| Penetration test | P | P | P | P | P | F | P | F | F | P | P | F |
| Long-term insulation resistance test in water | P | P | P | P | F | P | F | P | P | P | P | F |
| Appearance after test | P | P | P | P | F | P | F | P | F | F | F | P |

TABLE 4-continued

| | Example 1 | Example 2 | Example 3 | Conv. Ex. 1 | Conv. Ex. 2 | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|---|---|---|---|---|
| Overall evaluation | P | P | P | P | F | F | F | F | F | F | F | F |

Conv. Ex.: Conventional Example,
Comp. Ex.: Comparative Example,
P: Passed,
F: Failed The heat-resistant wires and cables in Examples 1 to 3, which correspond to the invention, had a small diameter and a small thickness but were all excellent in mechanical characteristics and long-term water-immersion properties, as shown in Table 4.

On the other hand, the electric wire having a single insulation layer (single-layer insulation wire) in Conventional Example 1 passed the both tests for mechanical characteristics and long-term water-immersion properties, but had a large diameter. The electric wire in Comparative Example 1 having a single layer in the same manner but having a smaller diameter and a smaller thickness passed the long-term insulation resistance test in water but failed both the abrasion resistance test and the penetration test, which shows that the insulation of the single-layer insulation wire needs to be thick to satisfy mechanical characteristics.

In Conventional Example 2 and Comparative Example 2 in which a single layer was provided using the polyamide-grafted polyolefin A used in Example 1, large water absorption was exhibited during the long-term insulation resistance test in water regardless of the insulation thickness and the samples failed the test.

In Comparative Example 3, a polyolefin grafted with polyamide 11 (PA 11) having a low melting point was used to form the outermost layer. The melting point of the polymer was not less than 170° C. but was softened at high temperature, and the samples thus did not pass the penetration test.

In Comparative Examples 4 to 6, the outer appearance after the long-term insulation resistance test in water deteriorated due to hydrolysis of the polymer and many cracks were generated on the outermost layer. Furthermore, the sample in Comparative Example 4 also failed the penetration test.

In Comparative Example 7 in which cross-linking was not performed, the sample failed the penetration test due to significant deformation of the inner layer, and also failed the long-term insulation resistance test in water due to deformation of the inner layer. The outer appearance after the long-term insulation resistance test in water was acceptable since no crack was observed, but the electric wire was deformed (had the insulation with uneven thickness) due to the deformation of the inner layer.

The invention is not limited to the embodiment and Examples and various modifications can be implemented.

What is claimed is:

1. A heat-resistant wire, comprising:

a conductor; and an insulation comprising not less than two layers and covering the conductor, wherein an outermost layer of the insulation comprises a flame-retardant resin composition having a melting point of not less than 200° C. and is cross-linked by exposure to ionizing radiation, the flame-retardant resin composition comprising a polyolefin grafted with polyamide as a base polymer, and wherein an amount of the polyolefin grafted with polyamide in 100 mass % of the flame-retardant resin composition is not less than 80 mass %.

2. The heat-resistant wire according to claim 1, wherein a layer of the insulation other than the outermost layer comprises a resin composition, and a base polymer of the resin composition comprises one or two or more selected from high-density polyethylene, linear low-density polyethylene, low-density polyethylene, ethylene-α-olefin copolymer, ethylene-vinyl acetate copolymer, ethylene-acrylic ester copolymer and ethylene-propylene-diene copolymer.

3. The heat-resistant wire according to claim 2, wherein the layer of the insulation other than the outermost layer is cross-linked by exposure to ionizing radiation.

4. The heat-resistant wire according to claim 2, wherein the layer of the insulation other than the outermost layer further comprises one or more additive selected from flame retardants, antioxidants, lubricants, surface active agents, softeners, plasticizers, inorganic fillers, compatibilizing agents, stabilizers, metal chelators, ultraviolet absorbers, light stabilizers and colorants.

5. The heat-resistant wire according to claim 1, wherein the polyamide has a melting point of not less than 200° C.

6. The heat-resistant wire according to claim 1, wherein a total thickness of the insulation is not more than 0.5 mm and the outer diameter of the wire is not more than 2.5 mm.

7. A heat-resistant cable, comprising: a twisted wire formed by twisting a plurality of the heat-resistant wires according to claim 1; and a sheath formed by extruding a flame-retardant resin composition to cover the twisted wire, wherein the sheath is cross-linked by exposure to ionizing radiation.

8. The heat-resistant cable according to claim 7, wherein the sheath is formed of a halogenated polyolefin.

9. The heat-resistant wire according to claim 1, wherein the polyolefin is an ethylene-based polymer or an ethylene-based copolymer.

10. The heat-resistant wire according to claim 9, wherein the polyolefin comprises one or more selected from high-density polyethylene, linear low-density polyethylene, low-density polyethylene, ethylene-α-olefin copolymer, ethylene-vinyl acetate copolymer, ethylene-acrylic ester copolymer and ethylene-propylene-diene copolymer.

11. The heat-resistant wire according to claim 1, wherein an amount of the polyolefin grafted with the polyamide contained in the flame-retardant resin composition is not less than 90 mass %.

12. The heat-resistant wire according to claim 1, wherein the flame-retardant resin composition has a melting point of not less than 205° C.

13. The heat-resistant wire according to claim 1, wherein the polyamide used for grafting is PA 6.

14. The heat-resistant wire according to claim 1, further comprising one or more flame retardants selected from bromine-based flame retardants, chlorine-based flame retardants, antimony trioxide, nitrogen-based flame retardants, phosphorus-based flame retardants, intumescent flame retardants, metal hydroxides, boric-acid compounds, stannate compounds and silicone-based flame retardants.

15. The heat-resistant wire according to claim 1, further comprising one or more additive selected from antioxidants, lubricants, surface active agents, plasticizers, inorganic fillers, compatibilizing agents, stabilizers, metal chelators, ultraviolet absorbers, light stabilizers and colorants.

16. The heat-resistant wire according to claim 2, wherein the flame-retardant resin composition comprising a polyolefin grafted with polyamide as a base polymer is cross-linked by exposure to ionizing radiation from an electron beam, gamma ray or X-ray at a dose from 10 kGy to500 kGy, or from an alpha ray at a dose from 1 to 10 kGy/hr.

17. The heat-resistant wire according to claim 1, wherein the amount of the polyolefin grafted with polyamide in the flame-retardant resin composition is not less than 95 mass %.

* * * * *